US007743760B2

(12) United States Patent
Woodland

(10) Patent No.: US 7,743,760 B2
(45) Date of Patent: Jun. 29, 2010

(54) REVERSE ENERGY BOW

(76) Inventor: Dennis R. Woodland, 63866 Ranger Rd., Montrose, CO (US) 81401

( * ) Notice: Subject to any disclaimer, the term of this patent is extended or adjusted under 35 U.S.C. 154(b) by 895 days.

(21) Appl. No.: 11/252,300

(22) Filed: Oct. 17, 2005

(65) Prior Publication Data

US 2006/0081232 A1 Apr. 20, 2006

Related U.S. Application Data

(60) Provisional application No. 60/619,828, filed on Oct. 18, 2004.

(51) Int. Cl.
*F41B 5/10* (2006.01)
*F41B 5/12* (2006.01)

(52) U.S. Cl. ..... 124/25.6; 124/25

(58) Field of Classification Search ..... 124/23.1, 124/24.1, 25, 25.6, 86, 88
See application file for complete search history.

(56) References Cited

U.S. PATENT DOCUMENTS 2,100,317 A * 11/1937 Hickman ..... 124/23.1
2,957,470 A * 10/1960 Barna ..... 124/23.1
3,238,935 A * 3/1966 Stanaland ..... 124/23.1
3,486,495 A * 12/1969 Allen ..... 124/25.6
3,515,113 A * 6/1970 Lawrence ..... 124/27
4,722,317 A * 2/1988 Hartwig ..... 124/25.6
4,976,250 A * 12/1990 Jeffrey ..... 124/25
5,630,405 A * 5/1997 Nizov ..... 124/25
6,267,108 B1 * 7/2001 McPherson et al. ..... 124/25
6,460,528 B1 * 10/2002 Gallops, Jr. ..... 124/25
2006/0054150 A1 * 3/2006 Kempf ..... 124/25

* cited by examiner

*Primary Examiner*—John Ricci

(57) ABSTRACT

An archery bow includes a main riser frame with limbs extending therefrom. Each of the limbs has forward ends extended from the main riser frame. A bowstring has wound ends that are wound onto each of wheel cams that are attached to the limbs. The bowstring has a middle section that is not wound onto the wheel cams and that begins and ends at points on the wheel cams that are proximate to the farthest points along the wheel cams from the main riser frame. An elongate tube is mounted to the main riser frame through the central bore, and has a front handle attached to the elongate tube outer surface, and positioned between the first and second pairs of limbs. A push rod is slidably mounted at least partially inside the elongate tube, and has a rearward handle disposed outside the elongate tube rearward end.

15 Claims, 3 Drawing Sheets

REVERSE ENERGY BOW

CROSS-REFERENCES TO RELATED APPLICATIONS

This application claims the benefit of U.S. Provisional Application No. 60/619,828, filed Oct. 18, 2004.

FIELD OF THE INVENTION

The present invention generally relates to shooting bows, and more particularly relates to hand-drawn, hand-held shooting bows designed for hunting and sport shooting.

BACKGROUND OF THE INVENTION

Archery bows have been known for centuries. Compound bows are a relatively recent development. The early compound bows included an eccentric wheel or cam, which provided a lesser pull weight (or let-off) at full draw than the maximum weight applied at an intermediate draw position. Thus, the compound bow stores a substantial amount of energy without requiring the archer to hold the maximum draw weight while aiming or waiting for a clear shot opportunity.

The technology of compound bows has evolved, including attempts to reduce the overall bow length. A short length makes carrying and handling the bow less cumbersome, a particular advantage in a blind or tree stand or when otherwise shooting in a constricted space or from a constricted stance. However, attempts to shorten compound bows have been met with problems because reducing the bow length tends to reduce power while amplifying certain forces acting on and within the bow that may make accurate aiming more difficult.

Accordingly, it is desirable to provide a relatively small hand-drawn and hand-held shooting bow designed for sport shooting. In addition, it is desirable to provide a relatively small shooting bow that is highly accurate and usable in confined areas and from numerous stances. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

To meet the above-stated needs and others, an archery bow is provided, comprising a main riser frame having a central bore and first and second pair of limbs extending from the main riser frame. Each of the limbs has rearward ends attached to the main riser frame, and forward ends extended apart from the main riser frame. The bow further includes first and second wheel cam assemblies, each comprising first and second wheel cams, and first and second axles rotatably mounting the first and second wheel cam assemblies to the respective first and second pair of limbs approximate their forward ends. A bowstring has wound ends that are wound onto each of the first wheel cams, and has a middle section that is not wound onto the first wheel cams and that begins and ends at points on the first wheel cams that are proximate to the farthest points along the wheel cams from the main riser frame. A first spring bowstring has a first end that is wound on the second wheel cam from the first wheel cam assembly, and a second end that is wound on the second axle mounting the second wheel assembly. Likewise, a second spring bowstring has a first end that is wound on the second cam wheel from the second wheel cam assembly, and has a second end that is wound on the first axle mounting the first wheel assembly. An elongate tube is mounted to the main riser frame through the central bore, and has forward and rearward ends. A front handle is attached to the elongate tube outer surface, and is positioned between the first and second pairs of limbs. A push rod is slidably mounted at least partially inside the elongate tube, and has a rearward handle disposed outside the elongate tube rearward end. A string dampener may be attached to the elongate tube outer surface and positioned between the bowstring middle section and the elongate tube forward end. An arrow retainer assembly may be attached adjacent to the elongate tube forward end.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

Figure 1:
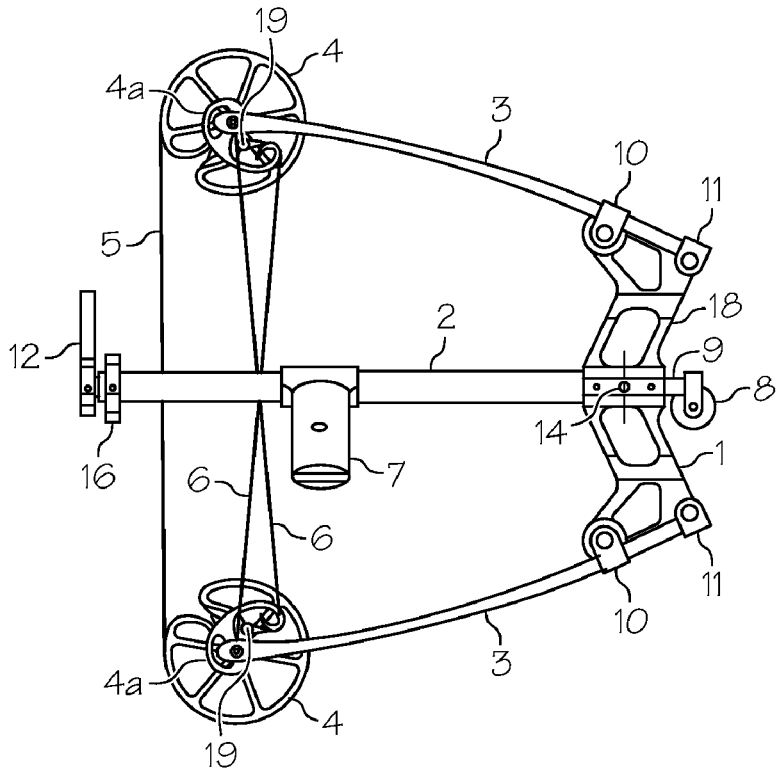
FIG. 1 is a left side view of an exemplary shooting bow according to the present invention.

The following detailed description of the invention is merely exemplary in nature and is not intended to limit the invention or the applications and uses of the invention. Furthermore, there is no intention to be bound by any theory presented in the preceding background of the invention or the following detailed description of the invention.

Turning now to FIGS. 1 to 4, an exemplary compound shooting bow is depicted according to an embodiment of the invention. While describing the bow 100, the term "forward" refers to the direction along the bow headed away from an archer operating the bow 100, and the term "rearward" refers to the direction along the bow headed toward the archer operating the bow 100. The bow 100 includes a main riser frame 1 that supports an elongate tube 2, and four limbs 3 that extend forwardly from the main riser frame 1. Each of the limbs 3 is attached approximate their rearward ends to the main riser frame 1 using a limb rocker retainer 11 and a limb rocker cam 10. The limb rocker retainers 11 fixedly mount the limbs 3 to the frame 1. The limb rocker cams 10 are forwardly disposed with respect to the limb rocker retainers 11, and mount the limbs 3 to the frame. However, the limb rocker cams are adjustable to allow for an increase or decrease in resistance when drawing a bowstring 5. From the main riser frame 1, the limbs 3 extend outwardly so the forward limb ends are farther apart than the rearward limb ends. An exemplary bow's forward limb pairs are separated by an axle-to-axle distance of about 30 to 36 inches. With the rearward limb ends positioned closely together, the area of the bow that is closest to the archer is the most compact bow region. This compactness allows the archer to operate the bow 100 by drawing the bowstring 5 from the hip or lap area much more easily than with conventional bows. Further, the overall bow is condensed in size to less than half the size of a conventional bow of equivalent force.

Figure 4:
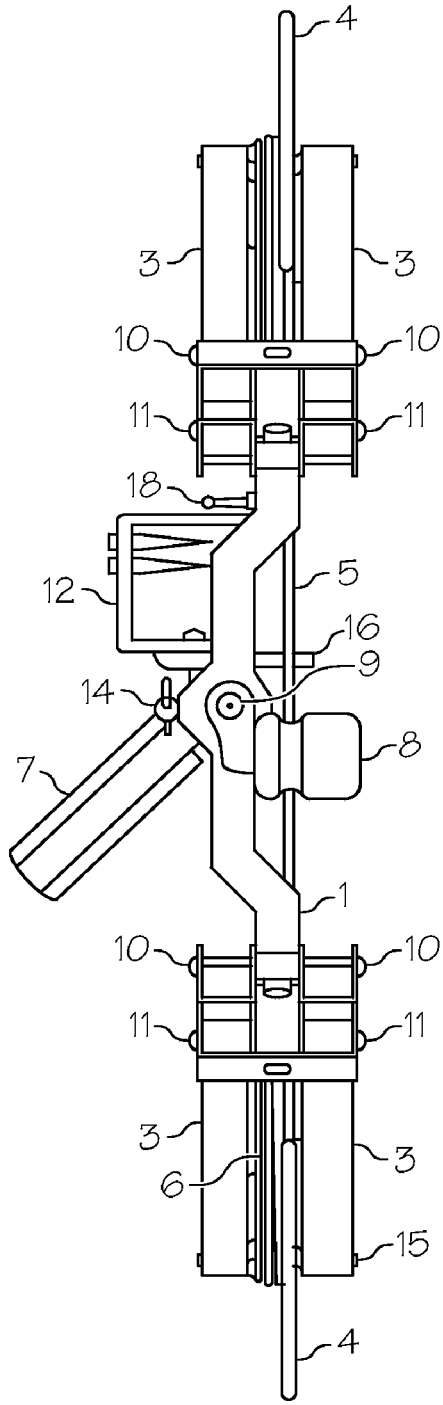
FIG. 4 is a rear view of the exemplary shooting bow.
Figure 5:
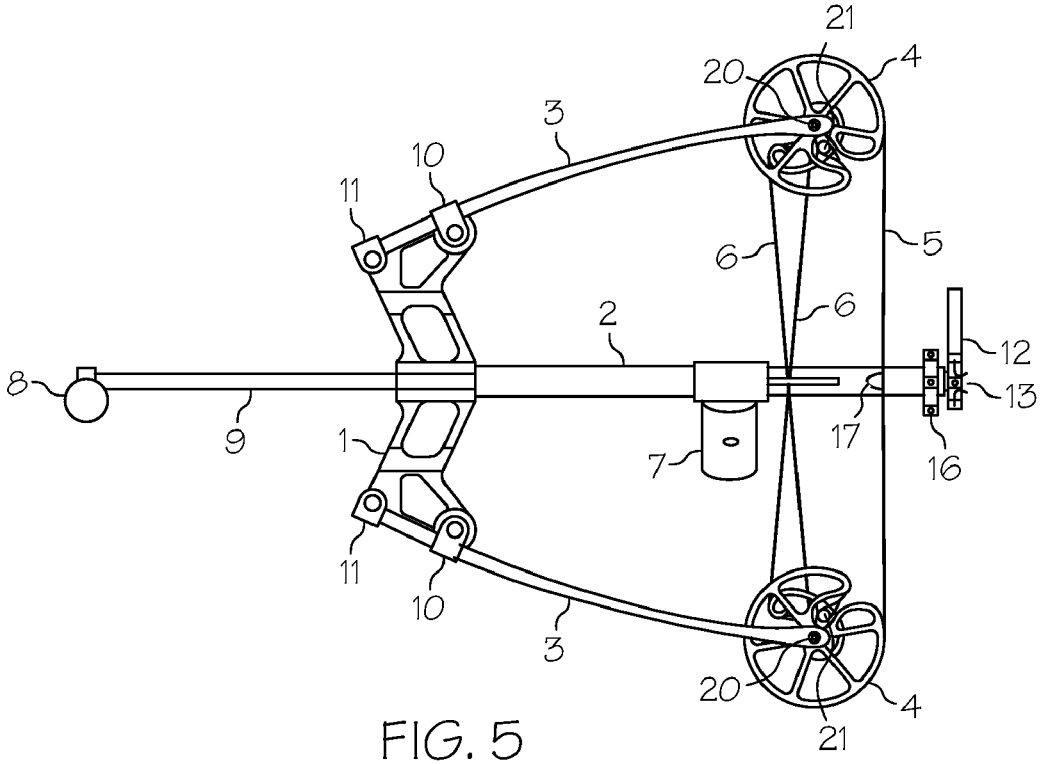
FIG. 5 is a right side view of the exemplary shooting bow with a stabilizer extended to a shooting configuration.
Figure 6:
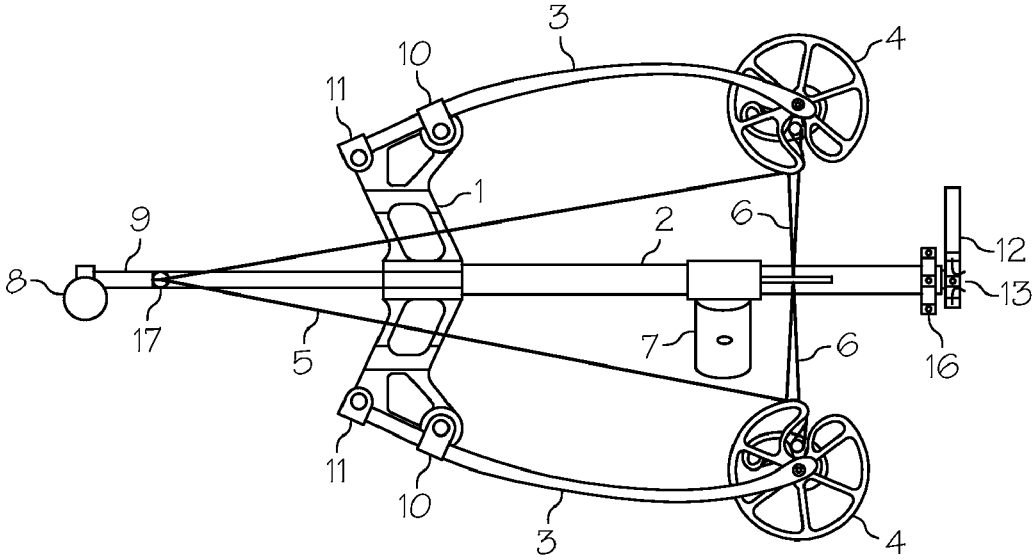
FIG. 6 is a right side view of the exemplary shooting bow with the string drawn in the shooting configuration.

An exemplary elongate tube 2 is a cylindrical body having an inner and outer surface. A handle 7 is mounted to the tube outer surface. When using the bow 100, the archer's forward hand, which would be the left hand for the illustrated bow 100, grips the handle 7 in order to stabilize and aim the bow 100. A push rod 9 is slidingly attached to the tube inner surface, and is attached to a rear handle 8 on which the archer's rearward hand may stably rest in order to further stabilize and aim the bow 100. FIG. 5 depicts the push rod 9 rearwardly extended from the elongate tube 2. FIGS. 4 and 6 depict a securing device 14 that retains the push rod 9 at an extended shooting position. There are numerous mechanisms that may be used to retain the push rod 9 in its position, and an exemplary securing device 14 is a push rod thumb screw. The push rod 9 and securing device 14 may be adaptable to allow the rear handle 8 to be positioned at a plurality of distances from the main riser frame 1, and to thereby accommodate archers with longer or shorter arms.

When the bow 100 is held in a vertical position, meaning that all four of the limbs 3 and the main riser frame 1 are in a substantially vertical plane, the handle 7 extends from the elongate tube 2 at an angle that allows the archer to comfortably and effectively aim and shoot. The handle 7 may be fixed at a set angle, such as a 45° from the vertical plane in which the bow 100 is normally held. The handle 7 may also be adjustably attached to the elongate tube 2 to allow an archer to suit his or her preferences. As an example, although the bow 100 is depicted in the drawings in a right-handed configuration with the handle 7 on the left side, the handle 7 may be simply rotated to right side of the elongate tube and secured in place using any recognized securing mechanism to bring the bow 100 to a left-handed configuration. Fasteners such as screws or other retaining devices for the forward handle 7 and the rear handle 8 can be loosened, and the handles switched to a left-handed configuration in a matter of minutes.

The elongate tube 2 also has a sight assembly 12 and a string dampener 16 mounted thereon. The sight assembly 12 includes a mounting portion to which the elongate tube 2 is attached, and a sight window that may be used by an archer in conjunction with a sight pin 18 to aim the bow 100. The sight assembly 12 and the sight pin 18 are adaptable for both left-handed and right-handed archers as well, and can be switched by simply loosening fasteners such as screws or other retaining devices.

The string damper 16 is disposed slightly forward with respect to the bowstring 5, and functions to dampen bowstring movement after the bowstring 5 is released and is forced forwardly from the drawn configuration illustrated in FIG. 6. When released, the bowstring 5 springs forward, past the relaxed position illustrated in FIGS. 1, 2, and 5. The string dampener 16 prevents the bowstring 5 from springing significantly beyond the relaxed position, and thereby attenuates any noise that the sprung bowstring 5 may create.

Figure 2:
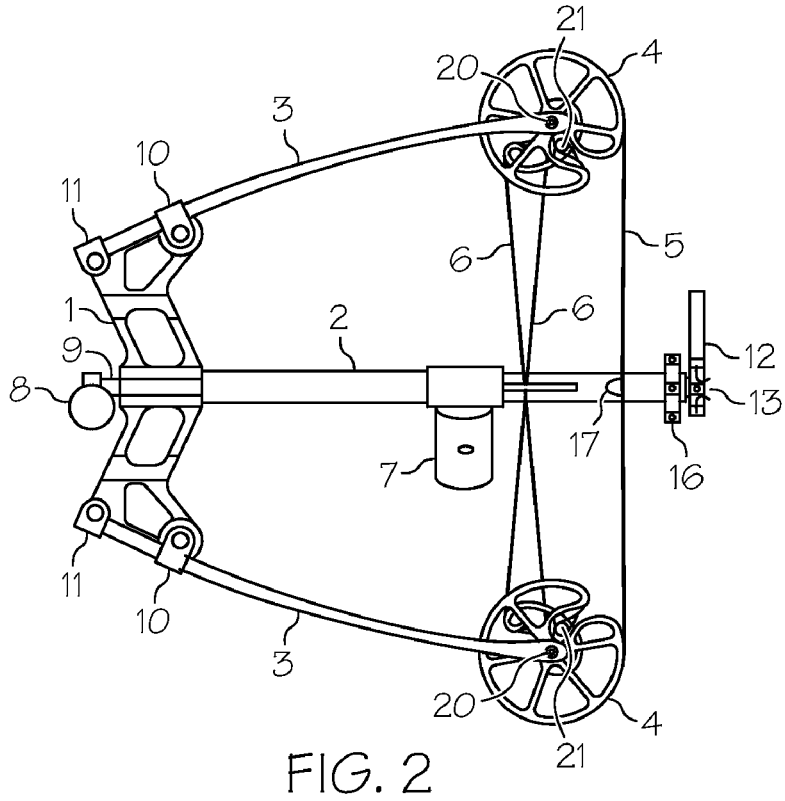
FIG. 2 is a right side view of the exemplary shooting bow.
Figure 3:
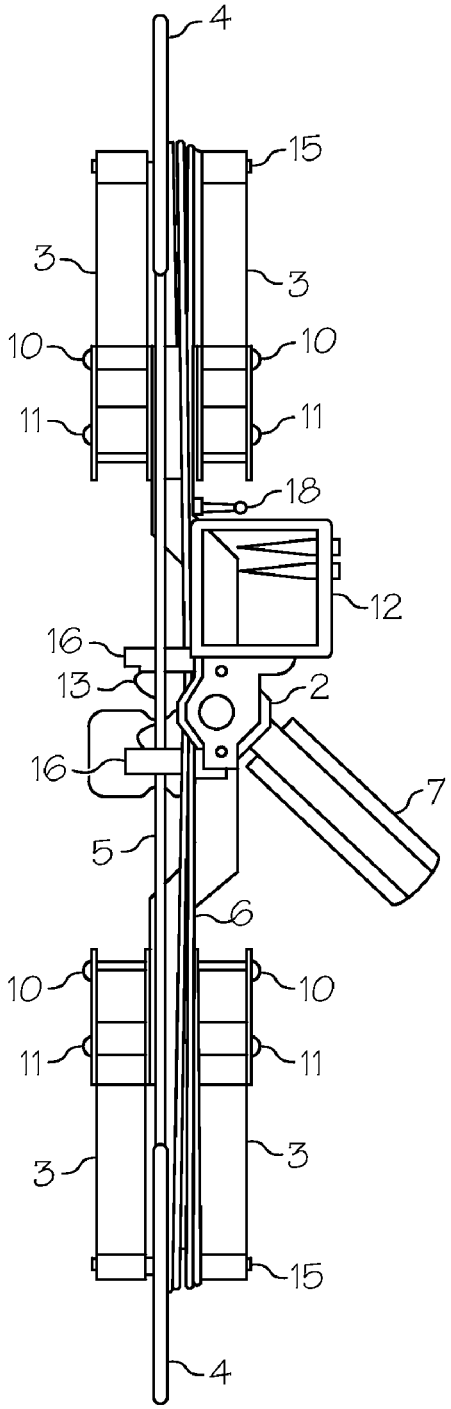
FIG. 3 is a front view of the exemplary shooting bow.

As seen most clearly in FIGS. 2 and 3, an arrow retaining assembly 13 is attached to the mounting portion of the sight assembly 12. An exemplary arrow retaining assembly 13 includes three retaining members that extend from their respective points of attachment to the sight assembly 12. Each retaining member includes a retaining tip. Together, the three retaining members converge with their tips in a common plane. The retaining tips define and surround a portion of the linear pathway that the arrow is forced along by the bowstring 5. Any substantial contact between the speeding arrow and the retaining tips is caused by a minor deviation from the linear pathway that some portion of the arrow may experience before the arrow passes the retaining assembly 13. One retaining member extends substantially perpendicularly from the sight assembly 12, and the other two retaining members form arcs such that the three tips converge.

The bowstring 5 is wound to a pair of large wheel cams 4, each of which is rotatably mounted to a string post 20 between the forward ends of two limbs 3. Although there are numerous suitable sizes for the large wheel cams, in an exemplary embodiment the wheels have a diameter ranging between 4 and 5 inches. A pair of small wheel cams **4*a* is also rotatably mounted to the axle 20, each small wheel cam 4*a* receiving a spring bowstring 6 and being adapted to have the spring bowstring 6 wound thereon. The large wheel cam 4 and the small wheel cam 4*a* are preferably integrally manufactured as a unitary assembly having a single unitary axis that enables the common rotation of both wheel cams 4 and 4*a* on the axle 20. Further, the unitary assembly may include the axle 20 formed integrally with both the large wheel cam and the small wheel cam 4*a***.

To attach the bowstring 5, a first bowstring end is attached to a string post 21 on one small wheel cam **4*a* and wound around the corresponding wheel 4, and a second bowstring end is wound around the other large wheel cam 4 and likewise attached to a string post 21 on the corresponding small wheel cam 4*a*. The bowstring 5 is wrapped such that a middle bowstring segment stretched between the two large wheel cams 4 is on the forward side of the wheels 4 instead of being on the rearward side of the large wheel cams 4. In other words, the bowstring 5 has wound ends that are wound onto each of the first wheel cams 4, and also has a middle section that is not wound onto the first wheel cams 4 and that begins and ends at points on the first wheel cams 4 that are adjacent and proximate to the farthest points along the wheel cams 4 from the main riser frame 1. To attach each of the spring bowstrings, a first spring bowstring end is attached to a string post 20, and a second bowstring end is wrapped partly around an opposite small wheel cam 4*a* and attached to a string post 19 on the corresponding large wheel cam 4**.

The bowstring 5 includes a D-loop 17 that an archer uses to draw the bowstring 5 rearwardly to the point depicted in FIG. 6. As depicted in FIG. 6, an exemplary configuration causes the large cam wheels 4 to rotate at least approximately 360°, and preferably more than 360° when the bowstring 5 is drawn. When the archer draws the bowstring 5, the drawing motion unwinds the large cam wheels 4. Drawing the bowstring 5 also causes the small cam wheels **4*a* to rotate, which in turn causes the spring bowstring 6 to be wound on the small cam wheels 4*a*. Winding the spring bowstring 6 forces the forward ends of the opposed limbs 3 toward each other in a compressed configuration. Since the limbs 3 are predisposed to maintain an expanded configuration, releasing the D-loop 17 allows the limbs 3 to be forced apart, causing the bowstring 5 to spring forward and be rewound onto the large cam wheels 4 and launch the arrow from the bow 100. When the bowstring 5 is drawn and then rewound, the large cam wheels 4 rotate in directions opposite to the bowstring wheels in conventional compound bows. Since the bowstring 5 is pulled from the side of the large cam wheels 4 that is farthest from the archer operating the bow 100, more forward force propelling the arrow is provided when the bowstring 5** is released from the drawn configuration.

Before drawing the bowstring 5, the handle 7 is positioned rearward with respect to the D-loop 17 on the bowstring 5. Thus, the drawing movement performed by the archer includes reaching forward with his or her drawing hand past the hand that is gripping the handle 7, and drawing the bowstring rearward toward the main riser frame 1 until the drawing movement is completed with the bowstring 5 near the rear handle 8. The drawing movement begins with the ball and socket of the archer's shoulder joint in a better-aligned position than when drawing a bowstring using a conventional bow, and allows the archer to pull more draw weight with less strain on the archer's body. Thus, the exemplary bow is entirely hand-drawn, and hand held when shooting the bow, without the use of a locking mechanism that would be included in a non-hand-held bow such as a crossbow.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. An archery bow, comprising:

a main riser frame having a central bore;

a first and second pair of limbs extending from the main riser frame, each of the limbs having rearward ends attached to the main riser frame, and forward ends extended apart from the main riser frame, the bow being configured to be operated with the first and second pair of limbs and the main riser frame in a substantially vertical plane;

first and second wheel cam assemblies, each comprising first and second wheel cams;

first and second axles rotatably mounting the first and second wheel cam assemblies to the respective first and second pair of limbs approximate their forward ends;

a bowstring having wound ends that are wound onto each of the first wheel cams, and having a middle section that is not wound onto the first wheel cams and that begins and ends at points on the first wheel cams that are proximate to the farthest points along the first wheel cams from the main riser frame;

a first spring bowstring having a first end wound on the second wheel cam from the first wheel cam assembly, and having a second end wound on the second axle mounting the second wheel assembly;

a second spring bowstring having a first end wound on the second cam wheel from the second wheel cam assembly, and having a second end wound on the first axle mounting the first wheel assembly;

an elongate tube mounted to the main riser frame through the central bore, the elongate tube having forward and rearward ends;

a front handle attached to the elongate tube outer surface and positioned between the first and second pairs of limbs; and a push rod slidably mounted at least partially inside the elongate tube and having a rearward handle disposed outside the elongate tube rearward end.

2. The archery bow according to claim 1, further comprising:

a string dampener attached to the elongate tube outer surface and positioned between the bowstring middle section and the elongate tube forward end.

3. The archery bow according to claim 1, further comprising:

an arrow retainer assembly attached adjacent to the elongate tube forward end.

4. The archery bow according to claim 3, wherein the arrow retainer comprises three approximately equally-spaced members converging around an arrow pathway.

5. A hand-drawn archery bow, comprising:

a main riser frame having a first end and a second end, and further having a forward side and a rearward side;

a first limb extending from the main riser frame first end, and a second limb extending from the main riser frame second end, each of the first and second limbs having a rearward end attached to the main riser frame, and a forward end extended apart from the main riser frame;

a first wheel cam assembly rotatably mounted to the first limb proximate to its forward end, and a second wheel cam assembly rotatably mounted to the second limb proximate to its forward end; and a bowstring having wound ends that are wound onto the first and second wheel cam assemblies, and having a middle section between the wound ends, wherein the bowstring and main riser frame are in relation with each other to have a relaxed configuration in which the bowstring middle section extends linearly between the first and second wheel cam assemblies, and a hand-drawn configuration in which the bowstring middle section extends across the main riser frame, and wherein the archery bow is devoid of a locking mechanism that can maintain the bowstring in the hand-drawn configuration; and a forward handle extending from the main riser frame to a position on the forward side of the main riser frame.

6. The hand-drawn archery bow according to claim 5, wherein the forward handle is disposed between the main riser frame and the bowstring when the archery bow is in the relaxed configuration.

7. The hand-drawn archery bow according to claim 5, further comprising an elongate tube extending from the main riser frame on the forward side, and having the forward handle supported thereon.

8. The hand-drawn archery bow according to claim 5, further comprising:

a rear handle extending from the main riser frame on the rearward side of the main riser frame.

9. The hand-drawn archery bow according to claim 8, wherein the rear handle is retractably positionable at various distances from the main riser frame on the rearward side of the main riser frame.

10. The hand-drawn archery bow according to claim 5, wherein the bowstring middle section is not wound onto the first and second wheel cam assemblies, and begins and ends at points on the first and second wheel cam assemblies that are proximate to points along the first wheel cams that are farthest from the main riser frame.

11. A hand-drawn archery bow, comprising:

a main riser frame having a first end and a second end, and further having a forward side and a rearward side;

a first limb extending from the main riser frame first end, and a second limb extending from the main riser frame second end, each of the first and second limbs having a rearward end attached to the main riser frame, and a forward end extended apart from the main riser frame;

a first wheel cam assembly rotatably mounted to the first limb proximate to its forward end, and a second wheel cam assembly rotatably mounted to the second limb proximate to its forward end;

a bowstring having wound ends that are wound onto the first and second wheel cam assemblies, and having a middle section between the wound ends; and a forward handle extending from the main riser frame to a position on the forward side of the main riser frame, wherein the forward handle is disposed between the main riser frame and the bowstring middle section when the archery bow is in the relaxed configuration wherein the bowstring and main riser frame are in relation with each other to have a relaxed configuration in which the bowstring middle section extends linearly between the first and second wheel cam assemblies, and a hand-drawn configuration in which the bowstring middle section extends across the main riser frame.

12. The hand-drawn archery bow according to claim 11, further comprising an elongate tube extending from the main riser frame on the forward side, and having the forward handle supported thereon.

13. The hand-drawn archery bow according to claim 11, further comprising:

a rear handle extending from the main riser frame on the rearward side of the main riser frame.

14. The hand-drawn archery bow according to claim 13, wherein the rear handle is retractably positionable at various distances from the main riser frame on the rearward side of the main riser frame.

15. The hand-drawn archery bow according to claim 11, further comprising:

a bowstring having wound ends that are wound onto the first and second wheel cam assemblies, and having a middle section that is not wound on the first and second wheel cam assemblies, and begins and ends at points on the first and second wheel cam assemblies that are proximate to points along the first wheel cams that are farthest from the main riser.

* * * * *